US006389782B1

(12) United States Patent
Kinugawa et al.

(10) Patent No.: US 6,389,782 B1
(45) Date of Patent: May 21, 2002

(54) METHOD AND APPARATUS FOR WRAPPING ELONGATED ARTICLE

(75) Inventors: Masaaki Kinugawa, Tokyo; Kazuya Sato, Osaka, both of (JP)

(73) Assignee: Kurz Japan Limited and Navitas Co., Ltd., Osaka (JP)

( * ) Notice: Subject to any disclaimer, the term of this patent is extended or adjusted under 35 U.S.C. 154(b) by 0 days.

(21) Appl. No.: 09/232,721

(22) Filed: Jan. 19, 1999

(30) Foreign Application Priority Data

Jan. 19, 1998 (JP) ..... 10-022692

(51) Int. Cl.[7] ..... B65B 51/10

(52) U.S. Cl. ..... 53/463; 53/209; 53/450; 53/550

(58) Field of Search ..... 53/550, 450, 209, 53/461, 463, 465; 156/230, 240, 247, 289

(56) References Cited

U.S. PATENT DOCUMENTS 4,888,082 A * 12/1989 Fetcenko et al. ..... 156/500
5,635,001 A * 6/1997 Mahn, Jr. ..... 156/290
5,665,194 A * 9/1997 Kay ..... 156/289
5,989,381 A * 11/1999 Murakami et al. ..... 156/281

FOREIGN PATENT DOCUMENTS

JP 6-46925 3/1994
JP 8-39922 2/1996

* cited by examiner

*Primary Examiner*—Stephen F. Gerrity
*Assistant Examiner*—Louis Huynh
(74) *Attorney, Agent, or Firm*—Barnes & Thornburg

(57) ABSTRACT

A method and an apparatus for wrapping an elongated article with using a tranfer printing film are provided. A transfer printing film comprising a substrate film and a pattern-decorated transfer layer on the substrate film is drawn out from a roll thereof, and fed to a surface of the article which is conveyed horizontally by the convey rollers. The printing film is subject to an adhesive application during the travel to the article on the rollers. A hot melt type adhesive is employed as the adhesive, which type of adhesive can be easily regulated in thickness by an applicator. The printing film adheres to the article by the thick hot melt type adhesive to the article surface, and pressed with heat to transfer the decorated transfer layer with adhesive together integrally. Peeling off the substrate film finally, a smooth, quality and decrated article with a pattern such as the grain of wood or stone is obtained superior in appearance, because the thick hot melt type adhesion between the transfer layer and the article satisfactorily cover the cracks, flaws, roughness of the article.

3 Claims, 8 Drawing Sheets

METHOD AND APPARATUS FOR WRAPPING ELONGATED ARTICLE

FIELD OF THE INVENTION

The present invention relates to a wrapping method and a wrapping machine for wrapping an elongated article with a cover material decorated with a desired pattern.

BACKGROUND OF THE INVENTION

A wrapping machine for wrapping an elongated article such as a pressed compilation of wood chips and an extruded product of plastic or metal substances with a wrapping sheet is known as disclosed in Japanese Examined Utility Model Patent Publication Kokoku No. 46925/1994. The machine generally has a conveyor for conveying the elongated article and a roll holder for holding a roll of the wrapping sheet decorated with a desired pattern such as the grain of wood or stone and the like. During the conveyance of the article, the wrapping sheet is drawn out from the roll and an adhesive is applied on one side thereof. Then, the sheet is fed to the article surface and pressed by a plurality of pressing rollers beside the conveyer, whereby the article is wrapped with the sheet adhering thereto.

When the wrapping sheet is manufactured from a synthetic resin, a thick sheet can be obtained, more than 100 microns thick, for instance. Therefore, by wrapping the article with such a thick sheet, cracks, flaws and roughness of the article surface are fully veiled, and thus, an appearance of the article is improved to exhibit a quality taste. But, in case of a fire or incineration, the synthetic resin-made sheet generates noxious fumes to cause environmental pollution. In addition, since the separation of the sheet and the article is difficult, the wrapped article is hard to be recycled.

On the other hand, a transfer printing technique can be used as well for wrapping the elongated article with a cover material. The technique employs a transfer printing film in place of the wrapping sheet. The printing film comprises a substrate film generally formed of a synthetic resin and a transfer layer having a desired pattern on the substrate film. Alternatively, the printing film may have a release layer between the substrate film and the transfer layer. The printing film is affixed to the article, and then, the transfer layer is transferred to the article from the substrate film by heat and press. Finally, the resin-made substrate film is peeled off from the article. Therefore, this technique can avoid the above-mentioned drawbacks.

However, since the article is wrapped with a thin transfer layer, the cracks, flaws and roughness of the article appear through the thin layer, and thus, the quality article superior in appearance cannot be obtained. In order to solve this problem, the article should be dressed to have a smooth surface before wrapping. But, this needs an additional dressing step.

Consequently, it is an object of the present invention to manufacture a wrapped elongated article having a smooth, excellent, quality surface superior in appearance by using a transfer printing film in a simplified manner.

SUMMARY OF THE INVENTION

According to the wrapping method of the present invention, it comprises a step for applying a hot melt type adhesive on a transfer layer of a transfer printing film, a step for affixing the printing film to an elongated article by means of the hot melt type adhesive, a step for transferring the transfer layer to the article from a substrate film of the transfer printing film, and a step for peeling off the substrate film.

According to the wrapping machine of the present invention, it comprises holding means for holding a roll of a transfer printing film, applying means for applying a hot melt type adhesive on a transfer layer of the printing film drawn out from the roll, conveying means for conveying an elongated article, affixing means for affixing the printing film by means of the adhesive to the article being conveyed by the conveying means, and transferring means for transferring the transfer layer to the article.

A transfer printing film comprising a substrate film and a pattern-decorated transfer layer on the substrate film is drawn out from a roll thereof, and fed to a surface of the article which is conveyed horizontally by the convey rollers, for instance. The printing film is subject to an adhesive application during the travel to the article on the rollers. A hot melt type adhesive is employed as the adhesive, which type of adhesive can be easily regulated in thickness by an applicator. The printing film adheres to the article by the thick hot melt type adhesive to the article surface, and pressed with heat to transfer the decorated transfer layer with adhesive together integrally. Peeling off the substrate film finally, a smooth, quality and decrated article with a pattern such as the grain of wood or stone is obtained superior in appearance, because the thick hot melt type adhesion between the transfer layer and the article satisfactorily cover the cracks, flaws, roughness of the article.

Although the obtained elongated article is wrapped with the thin transfer layer, the hot melt type adhesive can cover the cracks, flaws, roughness of the article. Besides, the hot melt type adhesive can be regulated to a desired thickness. Therefore, a smooth, quality and decrative article can be obtained superior in appearance.

Furthermore, the substrate film is finally removed from the article, and thus, although the substrate film is formed of a synthetic resin, the wrapped article obtained by the method or machine of the invention never generates noxious fumes to cause environmental pollution in case of a fire or incineration. In addition, the article obtained by the method of the invention is easy to be recycled.

The transferring means preferably comprises a press roller for pressing the transfer layer to the article and a heater for heating the press roller.

In this case, the transfer layer having the pattern is thermally transferred, the layer and the hot melt type adhesive are well sticked to the article together integrally and hard to be removed.

Alternatively, the machine of the invention comprises emboss-transferring means for transferring the transfer layer to the article with embossing the layer in place of the transferring means.

In this case, a desired pattern such as the grain of wood or stone and the like in the transfer layer can be realistic by the emboss technique. Furthermore, by regulating the thickness of the hot melt type adhesive beneath the transfer layer, the pattern turns to be more preferably realistic.

The emboss-transferring means preferably comprises an emboss-press roller for pressing the transfer layer to the article with embossing the transfer layer and a heater for heating the emboss-press roller.

In this case, the transfer layer having the pattern is thermally transferred, the layer and the hot melt type adhesive are well sticked to the article together integrally and hard to be removed. Furthermore, since the transfer layer and the hot melt type adhesive are softened by heat, a huge emboss-pressing force is not necessary.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

The present invention will now be described by way of preferred embodiments referring to the accompanying drawings.

Figure 1:
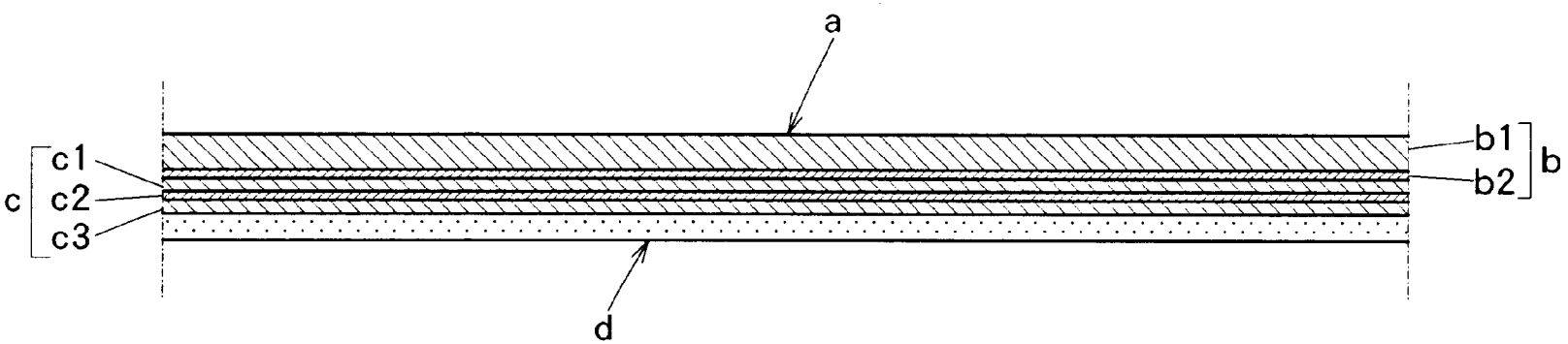
FIG. 1 is an enlarged sectional view of a transfer printing film employed in the wrapping method of the invention.

As shown in FIG. 1, a transfer printing film (a) used in the wrapping method of the present invention comprises a base layer (b) and a transfer layer (c). The base layer (b) includes a substrate film (b1) and a release layer (b2) disposed on one side of the substrate film (b1). The transfer layer (c) includes a topcoat (c1) adjacent to the release layer (b2), a pattern layer (c2) having a desired pattern and an undercoat (c3). The substrate film (b1) is formed of synthetic resin in more than 12 microns thick. The transfer layer (c) is formed of hot melt type resin in more than 5 microns thick.

The wrapping method of the invention begins with an adhesive applying step, in which a hot melt type adhesive (d) is applied on the transfer layer (c) of the transfer printing film (a). As the hot melt type adhesive (d) usable herein, an adhesive formed of a polyurethane, polyester, or acrylic resin can be preferably used. The adhesive (d) is applied in 25 microns thick. Thickness of the adhesive (d) may range from 15 to 100 microns. The adhesive (d) is maintained at 130° C. Temperature of the adhesive (d) may range from 100 to 150° C. The adhesive (d) is maintained at 11,000 cps. Viscosity of the adhesive (d) may range from 6,000 to 25,000 cps.

Next, the printing film (a) having the adhesive (d) thereon is affixed to a surface of an elongated article in the order of top face, both side faces and bottom face in an affixing step. During affixing, the film (a) is heated in order to avoid the cooling and curing of the adhesive (d), as required.

Next, the transfer layer (c) and the adhesive (d) are transferred together integrally to the article by heat and press in the order of top face, both side faces and bottom face in a thermal transfer step. Finally, the base layer (b) is peeled off from the article.

As stated above, although the obtained article is wrapped with the thin transfer layer (c), the hot melt type adhesive (d) can cover the cracks, flaws, roughness of the article (e). Besides, the adhesive (d) can be regulated to a desired thickness. Therefore, a smooth, quality and decrative article can be obtained superior in appearance. In addition, the transfer layer (c) having the pattern is thermally transferred, the layer (c) and adhesive (d) are well sticked to the article together integrally and hard to be removed.

Furthermore, the resin-made substrate film (b1) is finally removed from the article, and thus, the wrapped article obtained by the method of the invention never generates noxious fumes to cause environmental pollution in case of a fire or incineration. In addition, the article obtained by the method of the invention is easy to be recycled.

Optionally, the transfer printing film may have an adhesive layer on the transfer layer. The substrate film may be formed of paper or glassine.

Figure 2:
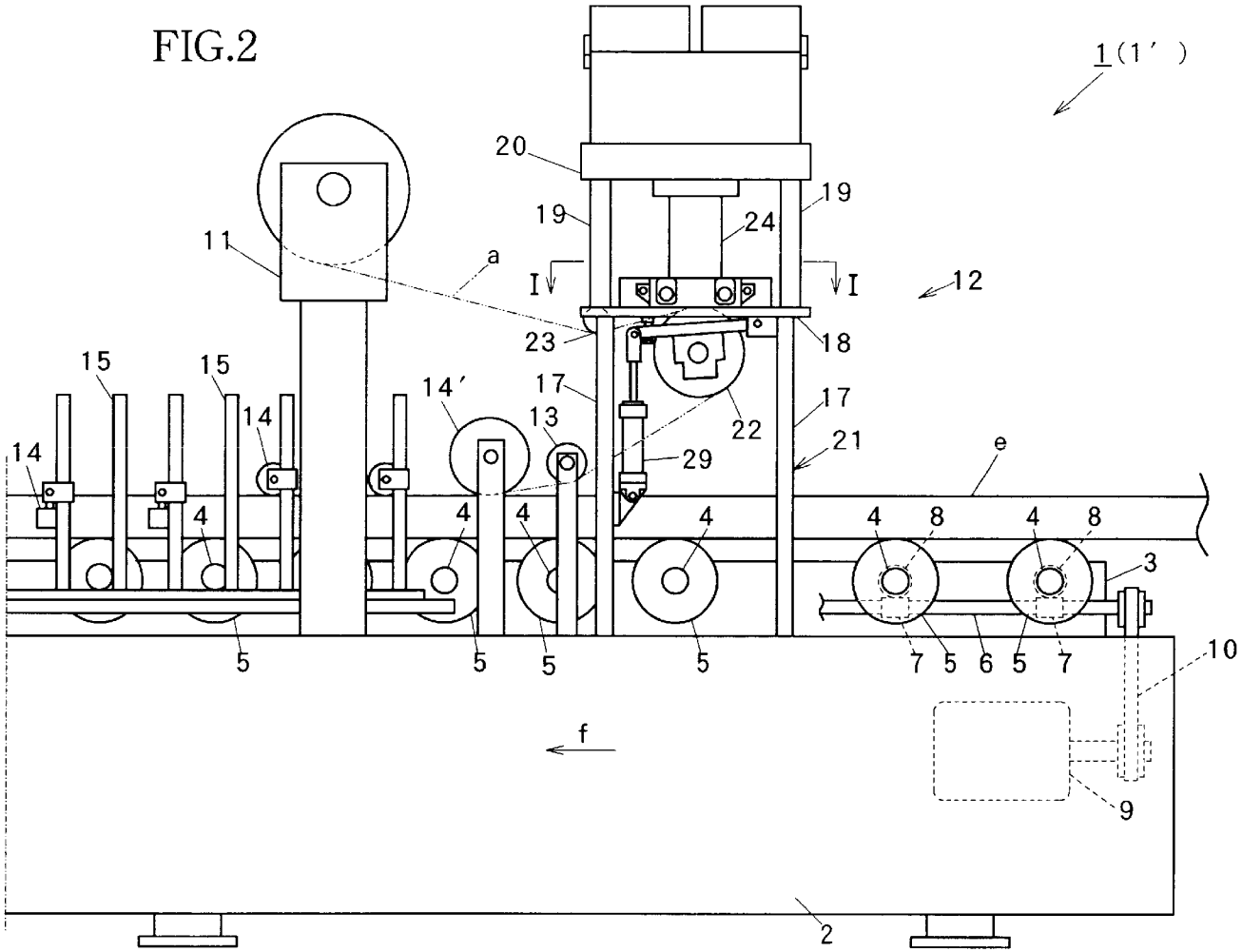
FIG. 2 is a partial front view of the wrapping machine of the invention showing an upper stream portion of the article moving path.
Figure 3:
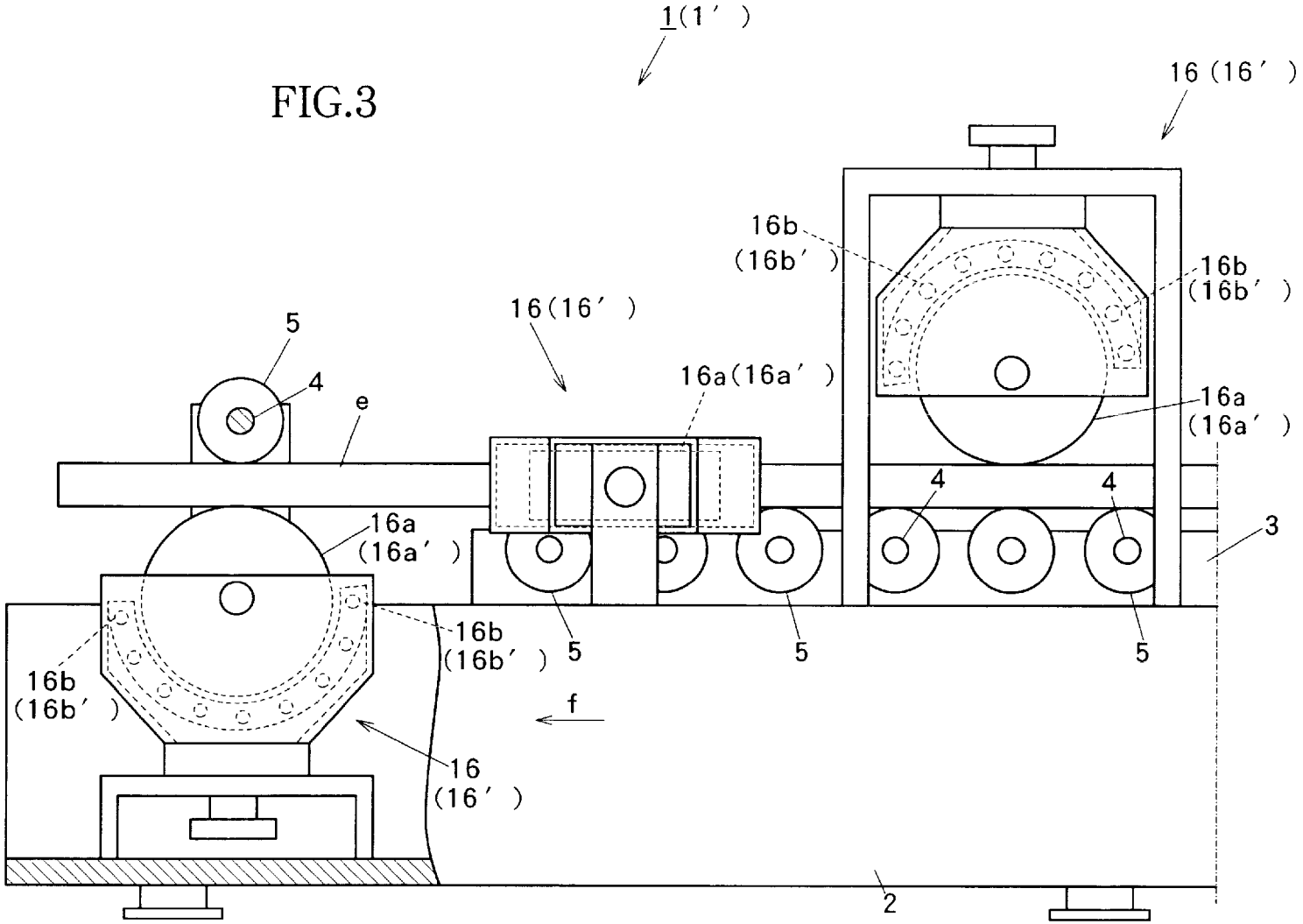
FIG. 3 is a partial front view of the wrapping machine of the invention showing a down stream portion of the article moving path.

As shown in FIGS. 2 and 3, a wrapping machine 1 of the present invention has a base 2 and a frame 3 on the base 2. The frame 3 extends longitudinally relative to the machine 1 and is provided with a plurality of shafts 4 . . . 4 for rotatably supporting convey rollers 5 . . . 5.

A drive shaft 6 extending parallel to the frame 3 is located beneath the roller shafts 4 . . . 4. The drive shaft 6 has a plurality of worm gears 7 . . . 7, each engaging a helical gear 8 mounted on the roller shaft 4. When the drive shaft 6 is driven by a driving motor 9 in the base 2 by means of a belt 10, all rollers 5 . . . 5 rotate to convey together an elongated article (e) thereon horizontally in the direction of arrow (f).

As shown in FIG. 2, in an upper stream portion of the article moving path, the machine 1 includes a roll holder 11 for holding a roll of the transfer printing film (a), an applicator 12 for applying the hot melt type adhesive (d) onto the transfer layer (c) of the printing film (a) drawn out from the roll held by the holder 11, and a guide roller 13 for guiding so-adhesive applied film (a) close to a surface of the article (e) on the convey rollers 5 . . . 5. The guide roller 13 may have a heater to keep up the adhesive (d) on the film (a) at a desired temperature, if necessary.

Along the article moving path are arranged a plurality of rods 15 . . . 15 extending vertically to leave a regular space therebetween. Each rod 15 is equipped with a roller 14 for affixing the printing film (a) to the article (e). The affixing rollers 14 . . . 14 are slidable along the rods 15 . . . 15 and changeable in angle to secure correct contact to the article (e). The adhesive (d) is kept up at a desired temperature by a heater (not shown) located along the path. The foremost bigger roller 14' positioned in an affix start point is particularly used when the article (e) is broad.

As shown in FIG. 3, in a down stream portion of the path, the machine 1 further comprises a plurality of transfer devices 16 . . . 16 for thermally transferring the transfer layer (c) of the film (a) to the article (e). Each device 16 has a press roller 16*a* for pressing the film (a) to the article (e) and a plurality of heaters 16*b* . . . 16*b* for heating the press roller 16*a*. The foremost device 16 is positioned above the article (e) to press a top face thereof. The second devices 16,16 are positioned beside the article (e) to press both side faces thereof. The rearmost device 16 is positioned beneath the article (e) to press the bottom face thereof. The press roller 16*a* and heaters 16*b* . . . 16*b* move together to adjust a pressing force.

As shown in FIG. 2, the applicator 12 is situated in a gym 21 consisting of lower poles 17 . . . 17 on the base 2, a lower plate 18 at tops of the poles 17 . . . 17, upper poles 19 . . . 19 on the lower plate 18, and an upper block 20 at tops of the upper poles 19 . . . 19. The applicator 12 comprises an application roller 22 having a heater therein. The transfer printing film (a) drawn out from the roll in the holder 11 is guided to a cylindrical surface of the application roller 22 by a first guide roller 23 attached to the gym 21, and then, introduced downward to be fed to the second guide roller 13 in the affix start point.

Figure 5:
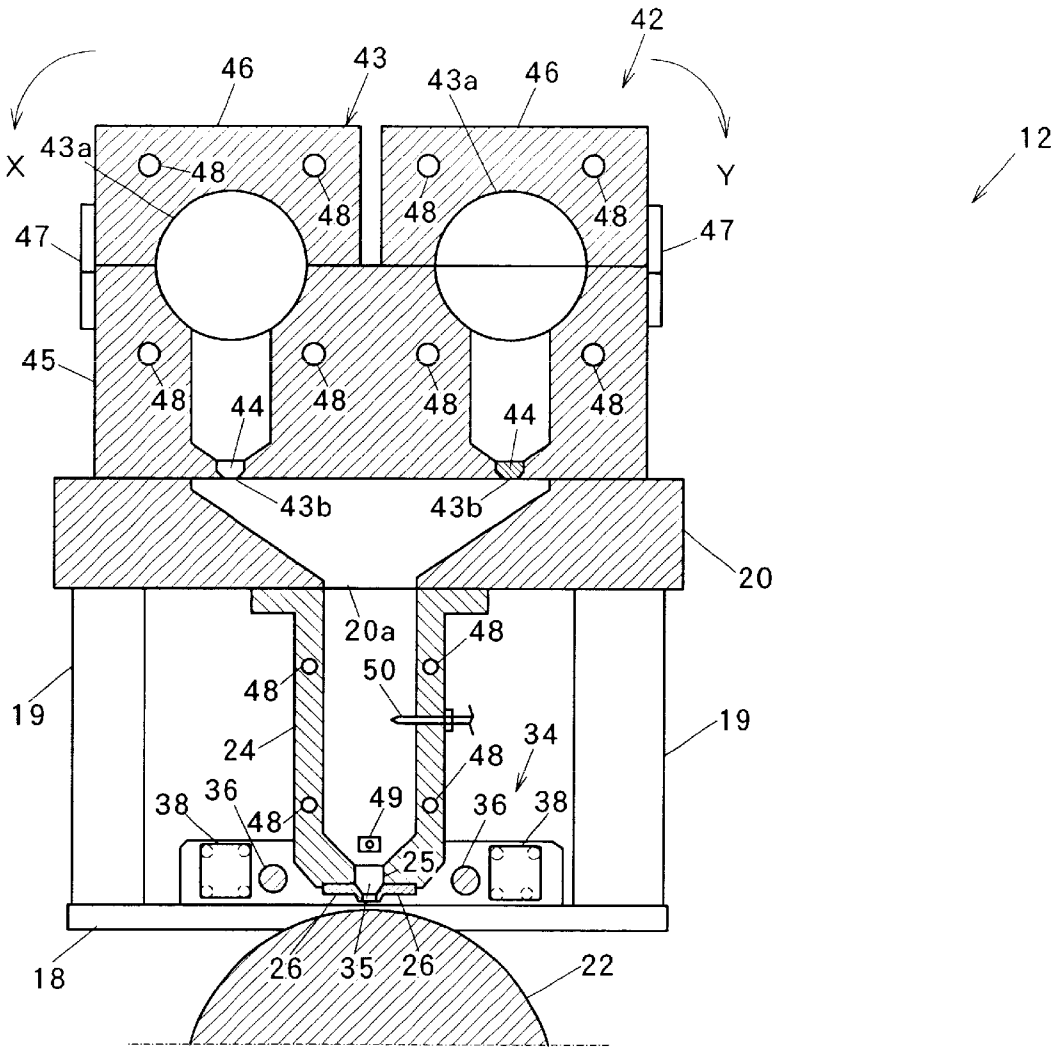
FIG. 5 is an enlarged sectional view of a main part of the applicator.

As shown in FIGS.2 and 5, the upper block 20 has an adhesive tank 24 hung therefrom. The tank 24 has an outlet 25 at a bottom end thereof. The outlet 25 is located just above the application roller 22 and formed like a slit extending in a breadth direction of the printing film (a) winding around the roller 22 (see FIG. 6). The outlet 25 is provided with nozzles 26, 26, through which the adhesive (d) in the tank 24 is fed to the film (a).

Figure 4:
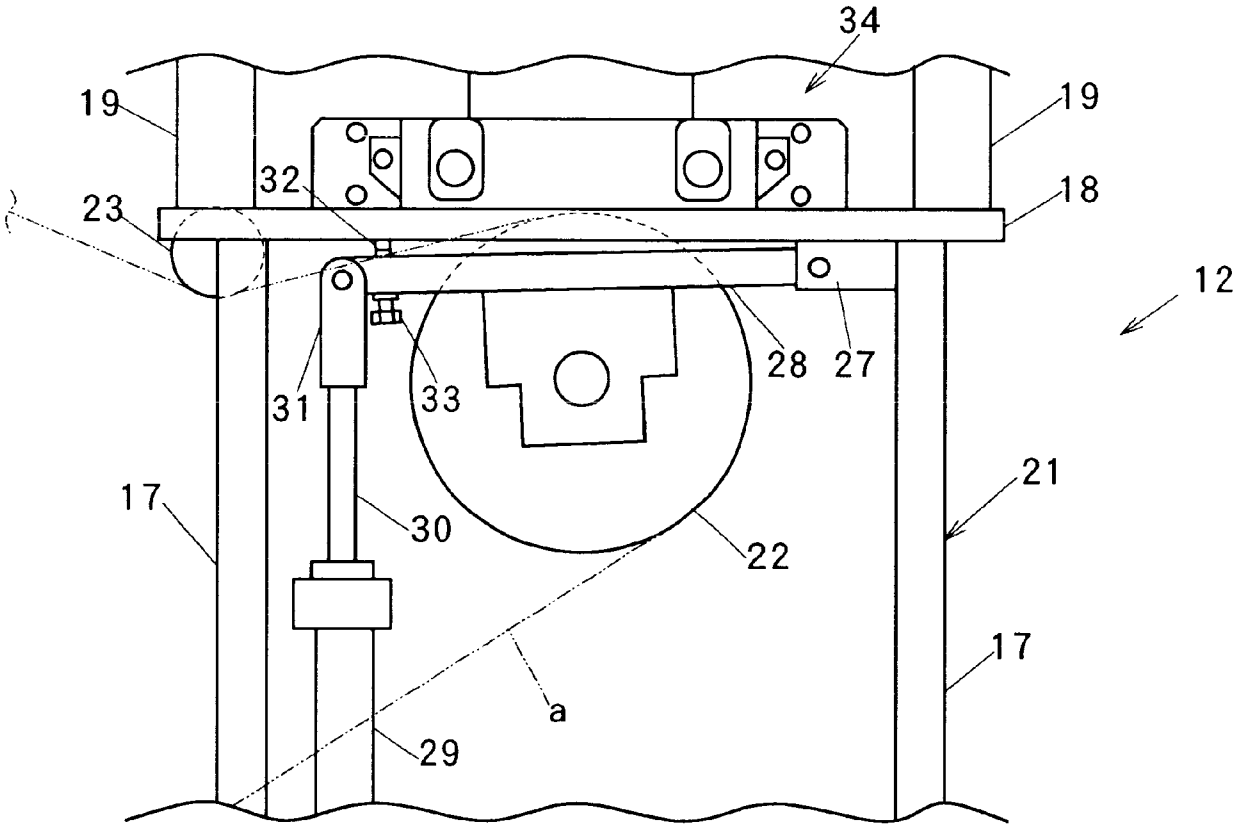
FIG. 4 is an enlarged partial view of an applicator in the wrapping machine of the invention.

As shown in FIG. 4, the application roller 22 is rotatably mounted on a midportion of a swing arm 28 pivotably supported by a bracket 27 fixed to the lower plate 18. The other end of the arm 28 is linked to a joint 31 attached to a rod 30 of a cylinder 29 mounted on the lower pole 17. As the rod 30 ascends and descends, the application roller 22 approaches to and recedes from the tank 24. A clearance between the printing film (a) on the roller 22 and the nozzles 26, 26 of the tank 24 is regulated by an adjustment bolt 33 equipped in the arm 28, which bolt 33 abuts against a projection 32 of the lower plate 18.

The applicator 12 further comprises a regulation mechanism for regulating an adhesive application range, or a length of the outlet 25.

Figure 6:
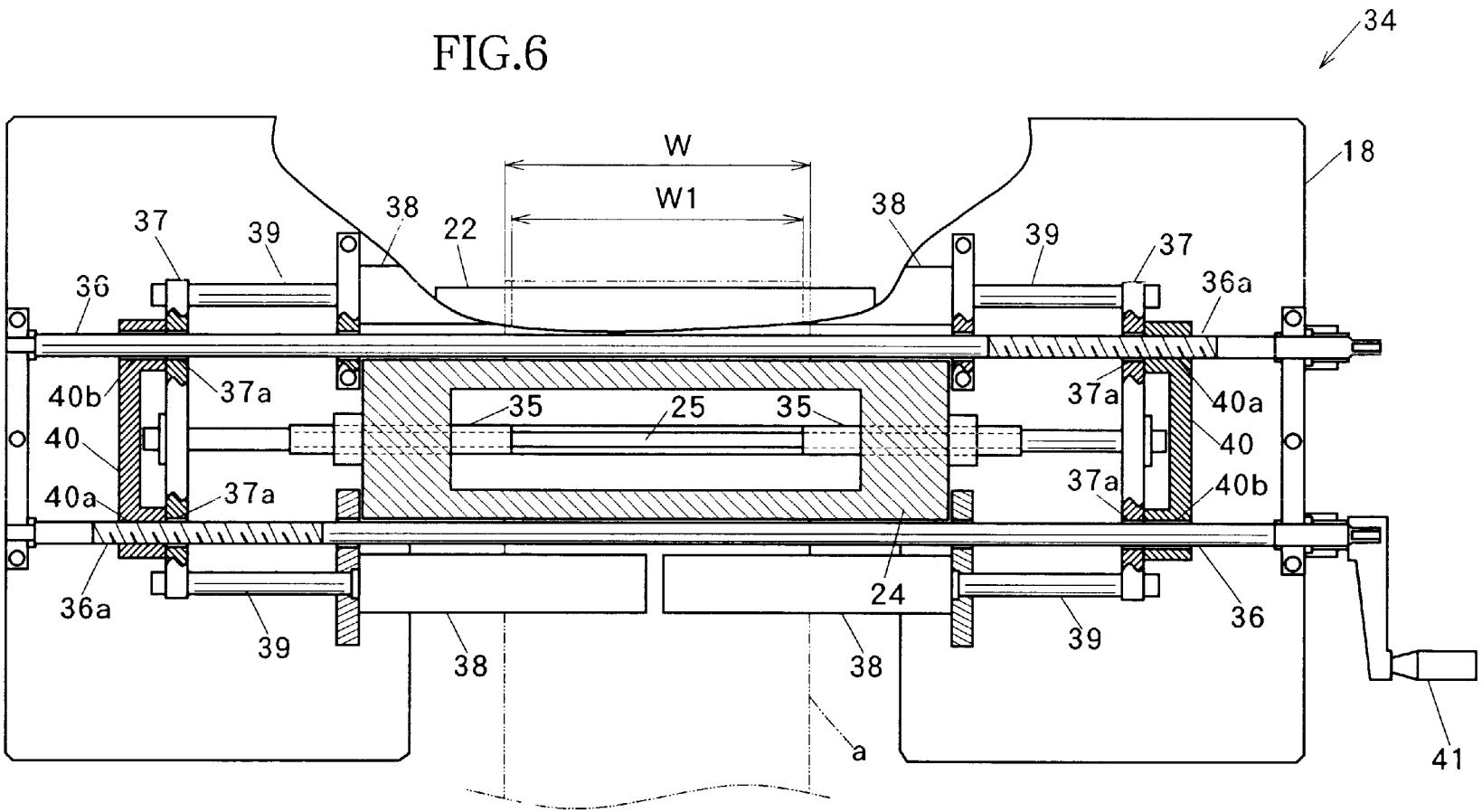
FIG. 6 is a sectional view of the applicator taken in the direction of the arrows I—I in FIG. 2.

As shown in FIGS.5 and 6, the mechanism 34 is located on the lower plate 18. The mechanism 34 includes a pair of sliders 35, 35 slidably engaged in a groove formed along the outlet 25. Each slider 35 is connected to a movable plate 37 outside the tank 24. The movable plates 37, 37 are connected to rods 39 . . . 39 of cylinders 38 . . . 38.

A pair of rotatable shafts 36, 36 pass through holes 37*a* . . . 37*a* in the movable plates 37, 37. Each shaft 36 also passes through a hole 40*b* in one of stoppers 40, 40 behind the movable plates 37, 37 and engages a threaded hole 40*a* in other stopper 40 with a threaded portion 36*a* thereo Both shafts 36, 36 are rotated by a handle 41.

As the rods 39 . . . 39 of cylinders 38 . . . 38 protrude and withdraw, the movable plates 37, 37 and sliders 35, 35 recede from and approach to each other along and being guided by the shafts 36, 36. Particularly, when the cylinders 38 . . . 38 actuate, the movable plates 37, 37 abut against the stoppers 40, 40 therebehind. On the other hand, as the shafts 36, 36 rotate, the stoppers 40, 40 move along and being guided by the shafts 36, 36. Thus, the application range of the adhesive (d) onto the printing film (a) is regulated by the positions of stoppers 40, 40 through the rotation of the shafts 36, 36.

Figure 7:
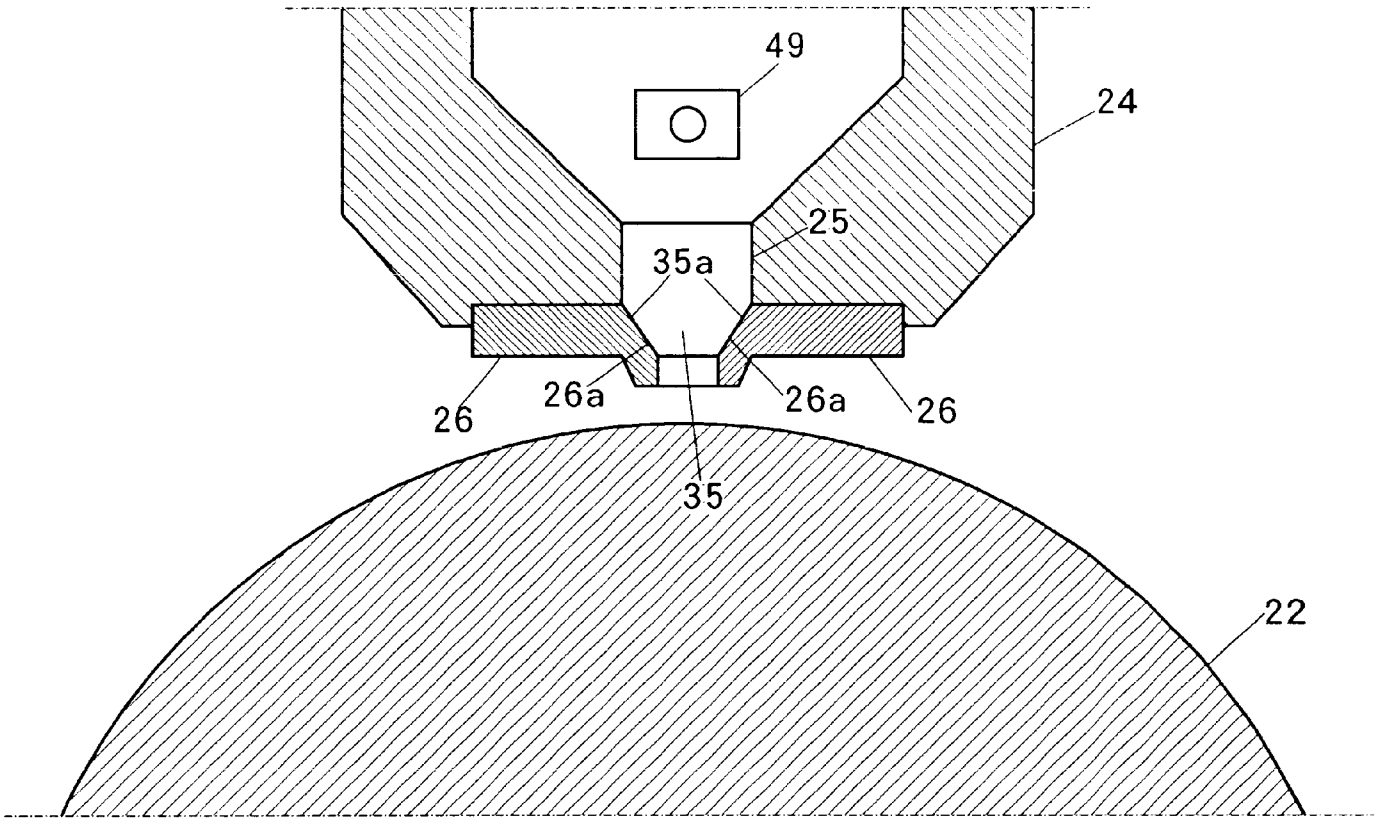
FIG. 7 is a still enlarged sectional view of the applicator showing an outlet of adhesive and an application roller.
Figure 8:
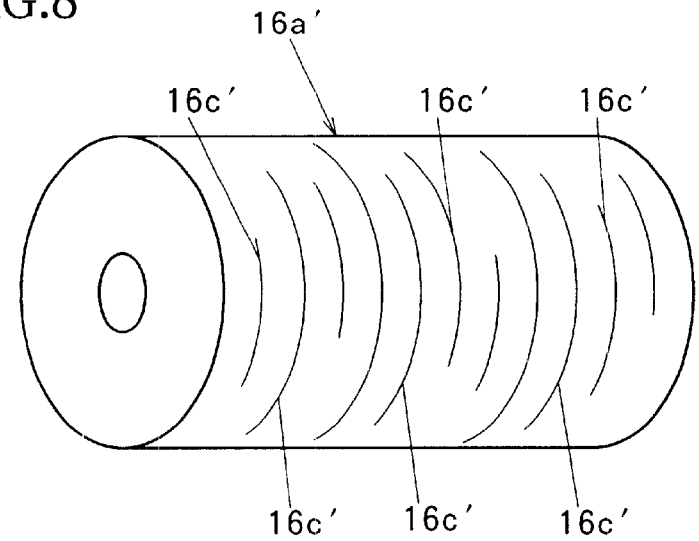
FIG. 8 is a perspective view of an emboss roller in the wrapping machine of the invention.
Figure 9:
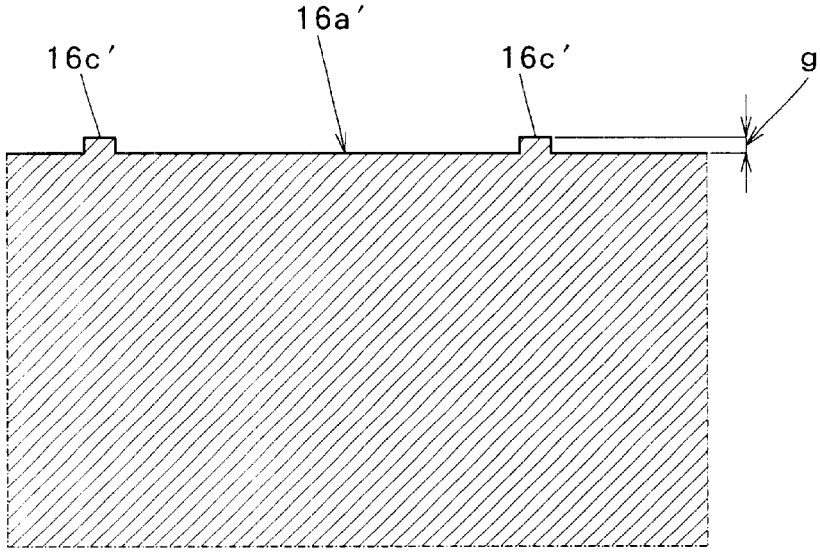
FIG. 9 is an enlarged partial sectional view of the emboss roller.

As shown in FIG. 7, the slider 35 is a hexagonal shape in cross section having C-faces 35*a*, 35*a*, and the nozzle 26 has a slanted inner face 26*a* corresponding to the C-face 35*a*. Therefore, under a weight of the adhesive (d), the C-faces 35*a*, 35*a* are urged to the slanted faces 26*a*, 26*a* so as to prevent gaps therebetween.

The applicator 12 further comprises a supply assembly for supplying an adhesive (d) to the tank 24.

As shown in FIG. 5, the assembly 42 includes a supply tank 43 installed on the upper block 20. The supply tank 43 has a lower member 45 and upper members 46, 46, each linked to the lower member 45 by hinge 47 to open as an arrow X, Y, respectively. When the upper members 46, 46 open, the adhesive (d) can be supplied in chambers 43*a*, 43*a* inside the supply tank 43. The chambers 43*a*, 43*a* connect to the main tank 24 through openings 43*b*, 43*b* at a bottom of the supply tank 43 and an aperture 20*a* in the upper block 20. A shutter 44 is slidably engaged in a groove formed along each opening 43*b*. The shutters 44, 44 open and close the openings 43*b*, 43*b* by an operation of unshown handle. Therefore, when either opening 43*b* is opened, the adhesive (d) for supplement in the chamber 43*a* thereof is supplied to the main tank 24.

The main tank 24 and supply tank 43 are provided with a plurality of heaters 48 . . . 48 to keep up the adhesive (d) inside at a desired temperature. The heaters 48 . . . 48 are controlled by unshown control unit which receives an output signal from a temperature sensor 49 in the main tank 24. The control unit further receives an output signal from a level sensor 50 in the main tank 24 and warns of a shortage of adhesive by means of unshown display unit.

In operation of the wrapping machine 1, the transfer printing film (a) drawn out from the roll in the roll holder 11 is applied the hot melt type adhesive (d) on the transfer layer (c) thereof by the applicator 12 when winding around the application roller 22, and introduced to the guide roller 13 in the affix start point. Then, the film (a) is fed to the surface of the elongated article (e) being conveyed by the convey rollers 5 . . . 5, and affixed to the article (e) by the affixing rollers 14 . . . 14 by means of the adhesive (d). As the article (e) is conveyed further, the transfer layer (c) of the film (a) is transferred to the article (e) by heat and press of the transfer devices 16 . . . 16 in the order of top face, side faces and bottom face of the article (e).

Although the article (e) is wrapped with the thin transfer layer (c), the hot melt type adhesive (d) can cover the cracks, flaws, roughness of the article (e). Besides, the adhesive (d) is regulated to a desired thickness by the clearance between the application roller 22 and nozzles 26 . . . 26 in the applicator 12. Therefore, a smooth, quality and decrative article can be obtained superior in appearance. In addition, the transfer layer (c) having the pattern is thermally transferred, the layer (c) and adhesive (d) are well sticked to the article (e) together integrally and hard to be removed.

The application range of the adhesive (d) onto the printing film (a) can be regulated by the regulation mechanism 34. Thus, as designated by (W1) in FIG. 6, the adhesive (d) is applied in a satisfactory range onto the printing film having a breadth of (W).

The adhesive (d) in the tank 24 never leaks from the outlet 25 when the outlet 25 is closed by the sliders 35, 35 on account of the close contact of C-faces 35*a*, 35*a* and slanted faces 26*a*, 26*a*.

The adhesive (d) is maintained at the desired temperature easy to handle at any time by the heaters 48 . . . 48 in the tanks 24, 43 controlled by the control unit.

When either of the chamber 43*a* is vacant, the adhesive (d) can be supplied by opening the upper member 46 thereof. Therefore, the operation can run continuously without stopping at the time of adhesive supply.

Optionally, the shutters 44,44 in the supply assembly 42 may be actuated by cylinder in place of the handle operation. In this case, receiving the signal from the level sensor 50, the control unit controls the cylinder to open either of the opening 43*b*.

Alternatively, as designated by dashed references in parenthesis in FIG. 3, the thermal transfer devices 16 . . . 16 may be substituted by thermal emboss-transfer devices 16' . . . 16'. Each device 16' has an emboss-press roller 16*a*' for pressing the printing film (a) to the article (e) with embossing the film (a) and a plurality of heaters 16*b*' . . . 16*b*' for heating the emboss-press roller 16*a*'. As shown in FIGS.

8 and 9, the roller 16*a*' is provided with a plurality of protrusions 16*c*' . . . 16*c*' defining the pattern such as the grain of wood or stone on a cylindrical surface thereof. A hight (g) of the protrusion 16*c*' is preferably 50 to 200 microns.

In the wrapping machine 1' of this modified mode of the invention, the transfer of the transfer layer (c) to the article (e) and the embossing the transfer layer (c) are achieved simultaneously by the devices 16' . . . 16'. The pattern such as the grain of wood or stone and the like on the article (e) can be realistic by the emboss technique.

In addition, by regulating the thickness of the hot melt type adhesive (d) beneath the transfer layer (c), the pattern turns to be more preferably realistic.

Since the transfer layer (c) having the pattern is thermally transferred to the article (e), the layer (c) and the hot melt type adhesive (d) are well sticked to the article (e) together integrally and hard to be removed. Furthermore, since the transfer layer (c) and the hot melt type adhesive (d) are softened by heat of the roller 16*a*' . . . 16*a*', a huge emboss-pressing force is not necessary.

There has been described a wrapping method and a wrapping machine for wrapping an elongated article with using a tranfer printing film. A transfer printing film comprising a substrate film and a pattern-decorated transfer layer on the substrate film is drawn out from a roll thereof, and fed to a surface of the article which is conveyed horizontally by the convey rollers. The printing film is subject to an adhesive application during the travel to the article on the rollers. A hot melt type adhesive is employed as the adhesive, which type of adhesive can be easily regulated in thickness by an applicator. The printing film adheres to the article by the thick hot melt type adhesive to the article surface, and pressed with heat to transfer the decorated transfer layer with adhesive together integrally. Peeling off the substrate film finally, a smooth, quality and decrated article with a pattern such as the grain of wood or stone is obtained superior in appearance, because the thick hot melt type adhesion between the transfer layer and the article satisfactorily cover the cracks, flaws, roughness of the article.

Japanese Patent Application No. 22692/1998 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wrapping machine for wrapping an elongated article using a transfer printing film having a substrate film and a transfer layer decorated with a desired pattern on the substrate film, which comprises:

(a) holding means for holding a roll of the transfer printing film;

(b) applying means for applying a hot melt type adhesive on the transfer layer of the transfer printing film drawn out from said roll;

(c) conveying means for conveying an elongated article;

(d) affixing means for affixing the transfer printing film by the adhesive to the article being conveyed by the conveying means; and (e) emboss-transferring means for heating and pressing the transfer printing film and the adhesive onto the article to emboss and transfer the transfer layer and adhesive to the article.

2. A wrapping machine as claimed in claim 1, wherein the emboss-transferring means comprises an emboss-press roller for pressing the transfer layer to the article with embossing the layer and a heater for heating the roller.

3. A wrapping method for wrapping an elongated article using a transfer printing film having a substrate film and a transfer layer decorated with a desired pattern on the substrate film, which comprises:

(a) applying a hot melt type adhesive on the transfer layer of the transfer printing film;

(b) affixing the transfer printing film to an elongated article by the hot melt type adhesive;

(c) subsequently heating and pressing the transfer printing film and adhesive onto the article to heat transfer the transfer layer and the adhesive to the article from the substrate film and (d) peeling off the substrate film;

(e) wherein step c includes simultaneously embossing the transfer printing film and the adhesive.

* * * * *